US005620359A

United States Patent [19]

Harrison et al.

[11] Patent Number: 5,620,359

[45] Date of Patent: Apr. 15, 1997

[54] KNIFE SHARPENER

[75] Inventors: Marc Harrison, Portsmouth, R.I.; Alain Vadrot, Paray-lo-Monial, France

[73] Assignee: Cuisine de France, Ltd., Shelton, Conn.

[21] Appl. No.: 320,197

[22] Filed: Oct. 7, 1994

[51] Int. Cl.[6] ..... B24B 3/36

[52] U.S. Cl. ..... 451/45; 451/267; 451/293

[58] Field of Search ..... 451/45, 193, 234, 451/241, 545, 267, 278, 293, 549

[56] References Cited

U.S. PATENT DOCUMENTS

| | | | |
|---|---|---|---|
| 2,860,452 | 11/1958 | Lebus | 451/241 |
| 3,071,899 | 1/1963 | Hicks et al. . | |
| 4,005,319 | 1/1977 | Friel . | |
| 4,265,056 | 5/1981 | Yamamoto . | |
| 4,612,731 | 9/1986 | Eckel . | |
| 4,627,194 | 12/1986 | Friel . | |
| 4,716,689 | 1/1988 | Friel | 451/285 |
| 4,807,399 | 2/1989 | Friel . | |
| 4,897,965 | 2/1990 | Friel . | |
| 5,245,791 | 9/1993 | Bigliano et al. . | |

*Primary Examiner*—Eileen Morgan

*Attorney, Agent, or Firm*—Nims Howes Collison Hansen & Lackert

[57] ABSTRACT

A knife sharpener (1) having a flexible grinding system includes a grinding wheel (2) and means for rotating the wheel, and has a fixed guide surface (14) for roughly positioning a knife for sharpening. A movable member (21) is disposed adjacent to the grinding member (17) of the grinding wheel, with the movable biased by a spring (26) in a direction towards the wheel. In operation, when a knife is moved into contact with the grinding wheel, the movable member is displaced inwardly to reduce the contact pressure such that only the knife edge contacts the wheel. Thus, rather than recontouring the knife edge, the knife edge is most closely returned to its original contour. Using such a flexible grinding system substantially maintains the original edge contour of the blade.

11 Claims, 4 Drawing Sheets

KNIFE SHARPENER

TECHNICAL FIELD

This invention relates to knife sharpeners and more particularly to a knife sharpener with a flexible grinding system.

BACKGROUND

Knife sharpeners typically include a rotating abrasive grinding wheel against which a blade edge is pressed so that an edge which has been dulled or otherwise rendered ineffective is reground to sharpen the edge. For example, in U.S. Pat. No. 4,716,689, a knife sharpener is described which includes a magnetic guide member having a fixed guide surface located adjacent to an abrasive surface with the guide surface being in a plane disposed at a predetermined angle to intersect the abrasive surface to form a line of intersection therewith. A pair of magnetic poles are oriented such that each lies along a line which is substantially parallel to the line of intersection so that the magnetic field created by the poles provides a thrust which moves the cutting facet into contact with the abrasive surface and provides a force to hold the cutting edge facet in contact with the abrasive surface. The guide surfaces are fixed relative to the grinding wheel. U.S. Pat. No. 4,897,965 and U.S. Pat. No. 4,627,194 describe similar knife sharpening apparatus with magnetic knife guide means. U.S. Pat. No. 5,005,319 discloses another knife sharpening apparatus which utilizes an orbiting sharpening member. Each of the mechanisms uses a fixed set of guides for determining the position of the blade relative to the grinding wheel.

One problem with these devices is that they tend to provide a single blade edge shape and angulation, regardless of the original edge shape and contour. This leads to a noticeable change in performance of many blades, despite obtaining a sharp edge. This is because blade designers develop an optimum blade edge for the anticipated use, i.e., a chopping knife edge may vary from a slicing knife edge. One knife may be very thin and flat, while another may have a thick blade with a wedge shape. But if both of these articles are sharpened with the prior art devices, both edge shapes will be modified by regrinding to conform to the orientation of the guide surfaces in the knife sharpener. This, of course, eliminates the optimal edge initially provided and thus the sharpened blade will never have the same edge as a new blade.

SUMMARY OF THE INVENTION

It is an object of the present invention to provide a knife sharpener which substantially maintains the original edge shape and angulation during sharpening.

It is a further object to provide a knife sharpener that has a flexible grinding system, which incorporates movable guide surfaces such that the blade edge contour is maintained during grinding, rather than regrinding the blade edge to a new contour.

These and other objects of the present invention are achieved by a knife sharpener comprising a grinding wheel, means for rotating the grinding wheel, a fixed guide surface and a movable guide surface disposed adjacent to the grinding wheel, the movable surface biased in a direction towards the grinding wheel.

In a preferred embodiment, the movable surface is located at an angle relative to the grinding wheel and has a magnet embedded beneath the surface for holding the flat of the blade against the movable surface, as the blade is drawn through the knife sharpener. This prevents the flat of the blade from inadvertently contacting the wheel. The movable surface is displaced by the blade shape as the edge is forced by manual pressure into contact with the wheel. This allows grinding of the blade edge in conformance with the original edge contour, as the physical structure of the blade pushes the movable surface outwardly to relieve the pressure against the grinding wheel and to thus avoid altering the contour.

In a preferred embodiment, the grinding wheel is counter-rotated, i.e. rotated in a direction opposite to the direction of insertion of the blade into the knife sharpener. Thus, the edge facet engages an abrasive surface moving in an upward direction, which has been found to enhance edge facet sharpening, by preventing friction from pulling the blade into more substantial contact with the wheel. This avoids face grinding and recontouring of the blade.

FIGS. *3a3d* are enlarged views showing the sharpening of a blade.

DETAILED DESCRIPTION OF THE INVENTION

Figure 1:
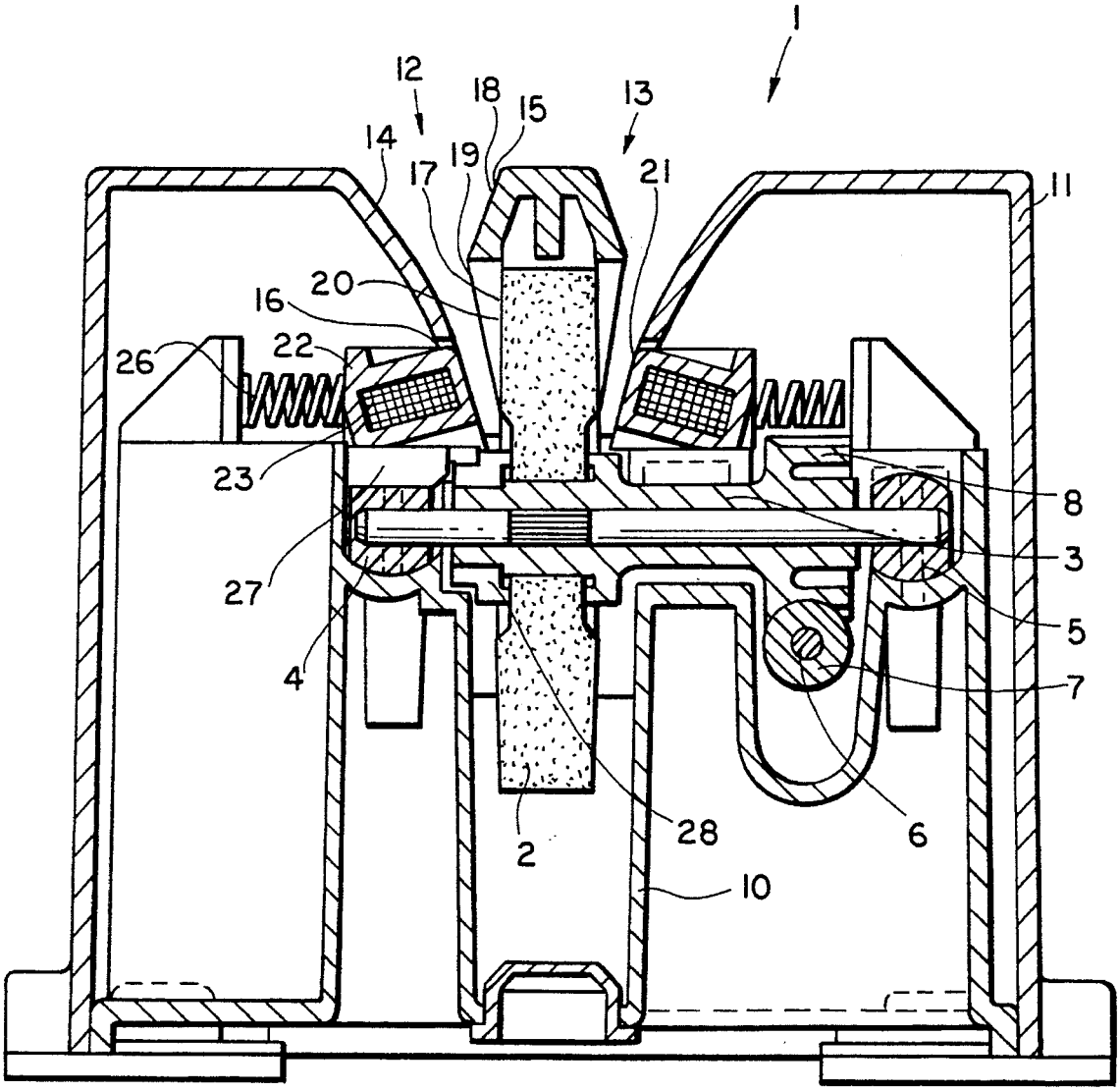
FIG. 1 is a cross-sectional view of a knife sharpener constructed in accordance with the present invention.

Referring to FIG. 1, a knife sharpener 1 has a grinding wheel 2 disposed therein. A drive shaft 3 is rotatably supported in bearings 4 and 5. A shaft 6 is connected by a worm gear 7 and a pinion 8 to a drive motor 9 (not shown) for rotating the wheel. Of course, various other arrangements are known for effecting rotation of the grinding wheel, and these alternatives are useable with the present invention.

The grinding wheel and associated drive devices are located in or on a frame member 10. A housing 11 surrounds the frame member to provide a cover for isolating and protecting the driving and rotating items. The housing includes a pair of longitudinal passages 12 and 13 which provide access by an article to be sharpened to the grinding wheel. This allows sharpening on both sides of a blade.

For purposes of illustration, the term "knife" or "blade" will be used to generically describe articles to be sharpened, though any article requiring edge sharpening may benefit from the invention. In addition, for ease of illustration, only a single passage of the knife sharpener will be described since the opposite passage is in essence a mirror image of the first passage.

Each longitudinal passage is defined by an outer surface 14 and an inner surface 15. The outer surface is defined as that positioned outwardly relative to the grinding wheel and the inner surface is defined as that surface positioned inwardly, closer to the grinding wheel. These surfaces, 14 and 15 are fixed in relation to the grinding wheel.

The outer surface serves to initially lead the article into proper contact with the grinding wheel. Generally the outer surface tapers towards the wheel to provide a gradually narrowing passage. The outer surface includes a longitudinal window 16 at a lower portion thereof, adjacent to a grinding surface 17 of the grinding wheel. The grinding surface 17 has a slight taper to assist in providing a sharp edge.

The inner surface prevents improper contact of the article with the grinding wheel, by having a pair of angled surfaces, an upper surface 18 which acts as a covering for the wheel and a lower angled surface 19, having an angled surface complimentary to the outer surface, so as to narrow the passage 12. The lower surface 19 has an opening 20 which provides access to the grinding surface 17. The lower surface surrounds the opening to prevent, for example, the flat of a blade from contacting the wheel. The inner and outer surfaces cooperate to approximately place the article into proper position for sharpening. Typically, this requires the passage to present the blade at an acute angle relative to the grinding surface.

Within the window 16 is disposed a movable guide member 21 for directing an article into contact with the grinding wheel. This member is independently movable relative to the adjacent inner surface and grinding wheel. The movable member is disposed at a complementary angle to the angle of the outer surface.

The movable member 21 has a blade guiding surface 22 which contacts the blade and a magnet 23 located within and adjacent to the movable guide surface. Means for biasing the guide member towards the grinding wheel are provided. In this instance, a spring 26 is used. The guide member includes a lip 27, which abuts a shoulder 28 on the frame to prevent contact of the member with the grinding wheel. However, movement away from the grinding wheel is restrained solely by the biasing means.

The distance between the surface 22 and the grinding wheel surface 17 must initially be quite close so that the blade is sandwiched between the guide surface 22 and the grinding surface 17 during sharpening. Generally a spacing of about 0.1 to about 0.7 mm and preferably about 0.2–0.5 mm should be used since many blades have a blade edge thickness of about 3–5 mm.

Figure 2:
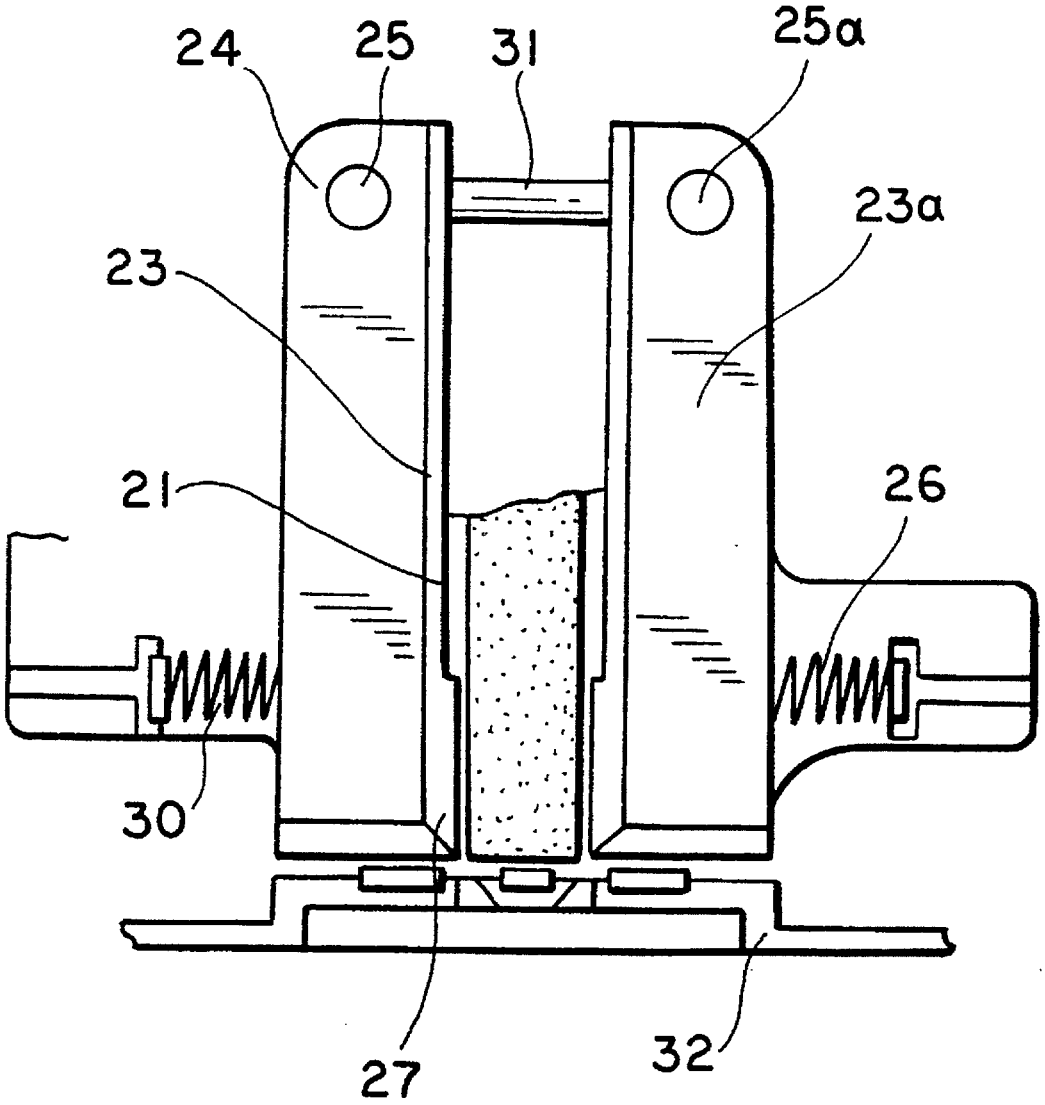
FIG. 2 is the top view of the embodiment of FIG. 1.

As best seen in FIG. 2, the guide member has an end 24 which is pivotally mounted on a pin 25 to allow inward and outward movement relative to the grinding wheel.

Various arrangements may be used to provide the biasing means effective in the grinding system of the invention. In accordance with the embodiment of FIG. 2, the member 23 has a spring 26 located around a projection 30. The spring is also in contact with an abutment 32, which is part of the frame 10. Thus, as the member moves outwardly, the spring is compressed between the abutment and the member.

In another embodiment of the invention, each of the members are connected via a preformed bridge 31 which extends between opposite ends of a pair of members 23 and 23*a*, with the members formed having a predetermined interference angle therebetween such that the bridge acts as the leaf spring which is manually overcome in the first instance during location of the guide members within the frame on the pivot hinges 25 and 25*a*. The lip 27 and shoulder 28 again prevent contact of the surface 22 with the wheel surface 17. Resistance (and thus biasing) increases as the amount of displacement from the natural interference position of the members occurs during sharpening.

Figure 3A:
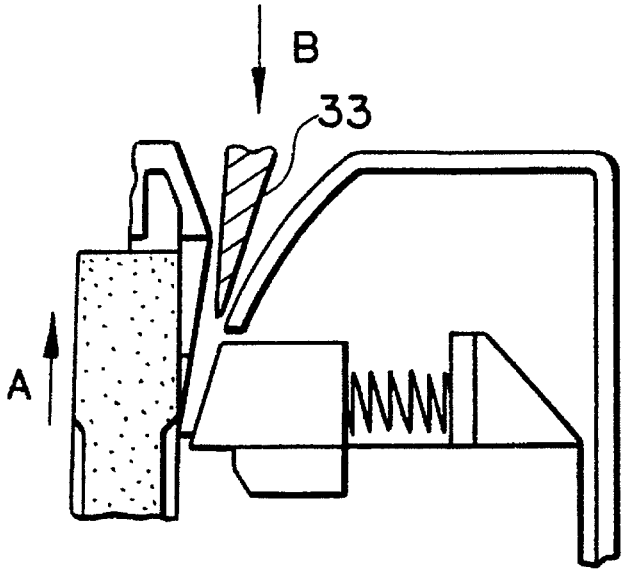
Figure 3B:
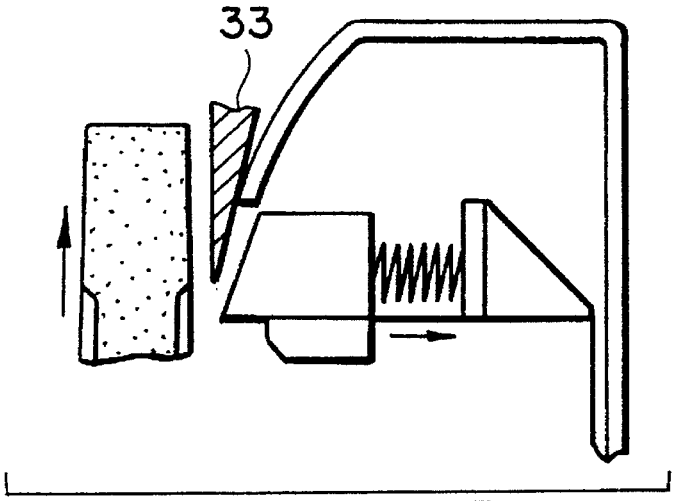
Figure 3D:
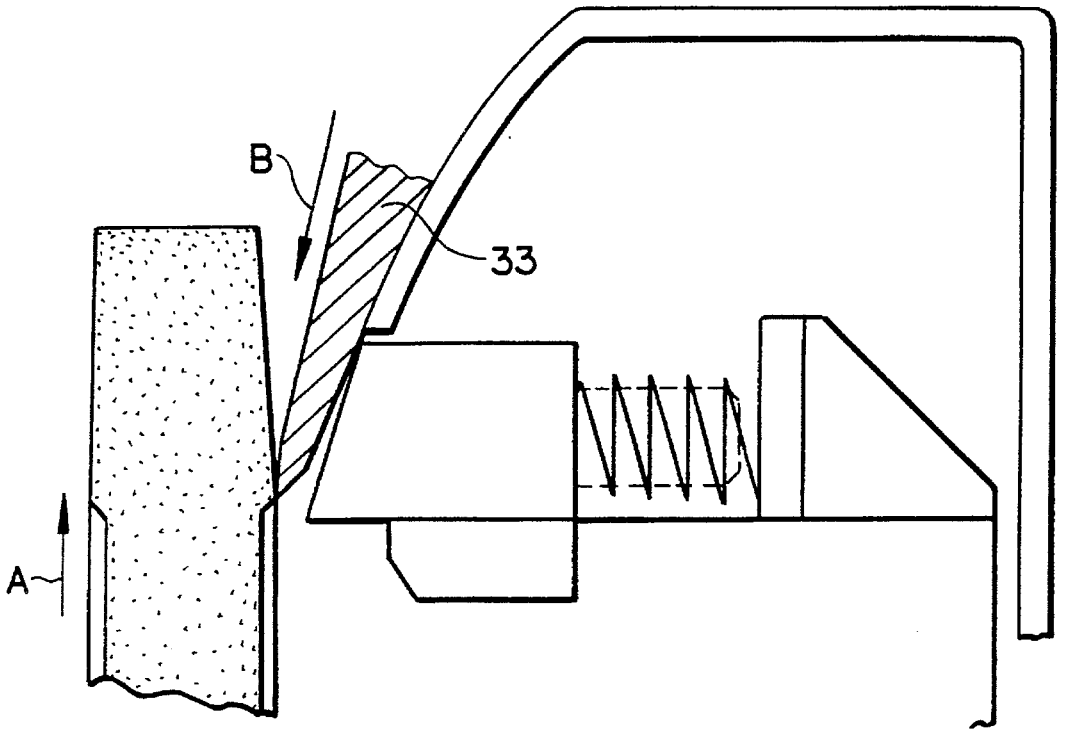
Figure 3C:
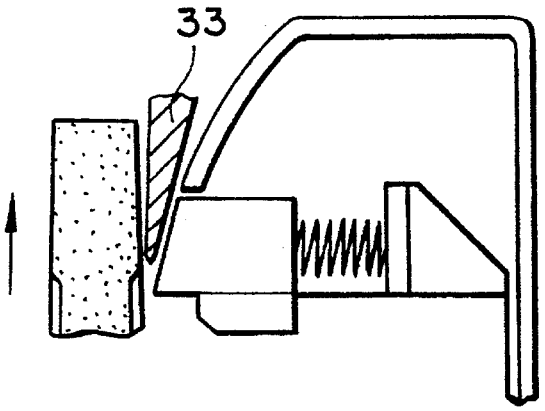

In operation, as shown in FIGS. 3*a*–3*d*, a knife 33 is placed in the passage and the inner and outer surfaces roughly align the knife with the grinding wheel (FIG. 3*a*). The magnet then pulls the blade onto the movable surface (FIG. 3*b*). At this time, the alignment of the blade may cause the member 23 to displace outwardly in response to the manual pressure applied. Manual pressure is also exerted to draw the blade through the passage and to press the blade into contact with the grinding wheel, as shown in FIG. 3*c*. At this point, the biasing spring exerts an inward force to place the edge in proper alignment for sharpening. If a high portion of the blade contacts the wheel, the biasing means are overcome and the movable surface is displaced inwardly, to balance the force applied by the person drawing the blade through the knife sharpener (FIGS. 3*a*3*d*). The angle of the surface 22 guides the movable knife into proper alignment once the forces are balanced (FIG. 3*d*). Thus, only the blade edge contacts the wheel.

In a preferred embodiment of the invention, the grinding wheel 2 is rotated in a direction counter to the insertion direction of the knife 33. This direction of rotation is achieved by choosing the proper orientation of the worm gear 7 and the pinion 8, or by the selection of a drive motor with the selected direction of rotation.

Referring again to FIGS. 3*a*–3*d*, the wheel is indicated by the arrow A to be moving in an upward direction, while the knife 33 is indicated by arrow B to be moving in a downward direction. It has been found that this direction of rotation assists in maintaining the blade edge in proper contact with the wheel. When the wheel and blade move in the same direction, there is a tendency for friction to pull the knife blade further into contact with the wheel, resulting in face grinding and blade edge recontouring. On the other hand, the upward movement exerts a friction force which tends to reduce the area of surface contact, by pushing the blade out of contact with the wheel. This is balanced by the manual force applied by the person effecting the sharpening, such that contact is minimized and concentrated on the edge facet. This balancing of forces is complimentary to the balancing achieved with the biased movable surface, to assist in assuring that the original edge contour is maintained.

By providing a movable surface, it is not necessary to recontour the blade to obtain a sharp edge. Rather, the high surfaces displace the movable surface inwardly such that the only substantial contact between the knife and the grinding wheel is the edge which requires sharpening. Thus, the flexible grinding system of the invention provides an advanced apparatus for knife sharpening which substantially maintains the original blade contour during sharpening of the edge facet. If such a knife were sharpened in accordance with the prior devices, the high surface portions would have to be grounded down before the edge would even be contacted by the grinding wheel, a long and unnecessary recontouring operation.

In a preferred embodiment of the invention, both the leaf spring and the coil springs are used together to adjust spring pressure, and thus to provide sufficient pressure for smooth sharpening. It should be understood that the biasing means must be sufficiently strong so as to keep the edge in contact with the wheel, but not so strong as to result in significant reconfiguration or regrinding of the blade edge. Insufficient spring pressure may result in blade wobble or bouncing on the grinding surface and therefore result in uneven grinding. With that proviso, numerous variations in the spring type and location may be arrived at by one skilled in the art. The constant pressure asserted by the biasing means, particularly when combined with a counter-rotating wheel, gives a uniform edge facet, the movable surfaces assuring that the contact angle is proper for sharpening the edge to substantially the original contour.

While preferred embodiments of the invention have been shown and described, it will be understood by one skilled in the art that various changes or modification could be made while vary from the scope of the present invention.

What is claimed is:

1. A knife sharpener comprising:

a grinding wheel;

means for rotating the grinding wheel;

a fixed guide surface for directing a knife blade into contact with the grinding wheel; and, a movable guide member disposed adjacent to a grinding surface on the grinding wheel; and adjacent to the fixed guide surface means for biasing the movable member in a direction towards the wheel to adapt by inward displacement to various blade contours while assuring constant contact pressure with the wheel.

2. The knife sharpener of claim 1 further comprising a magnet located within the movable member.

3. The knife sharpener of claim 1 wherein the biasing means comprise a spring.

4. The knife sharpener of claim 1 wherein the biasing means comprise a resilient leaf spring member.

5. The knife sharpener of claim 1 further comprising a housing for surrounding the grinding wheel and the means for rotating a grinding wheel, the fixed guide surface integrally formed with the housing.

6. The knife sharpener of claim 1 further comprising an inner guide surface, the inner and fixed guide surfaces defining a passage therebetween.

7. The knife sharpener of claim 1 wherein the fixed guide surface has a window at a lower portion thereof, the movable member located within the window.

8. The knife sharpener of claim 1 further comprising a frame, the grinding wheel and means for rotating the grinding wheel mounted on the frame, the frame having a lip positioned in close proximity to the grinding wheel, the movable member having a shoulder for engaging the lip, the lip providing a stop to prevent contact of the movable member with the grinding wheel.

9. The knife sharpener of claim 1 wherein the means for rotating the grinding wheel are adapted to rotate the wheel in a direction opposite to the direction of insertion of the knife blade into the knife sharpener.

10. A method for sharpening a knife comprising:

providing a knife sharpener having a grinding wheel, means for rotating the grinding wheel, a fixed guide surface for directing a knife blade into contact with the grinding wheel, and, a movable guide member disposed adjacent to a grinding surface on the grinding wheel, and adjacent to the fixed guide surface means for biasing the movable member in a direction towards the wheel to adapt by inward displacement to various blade contours while assuring constant contact pressure with the wheel;

providing a knife having a blade contour and an edge to be sharpened;

moving the knife along the fixed guide surface towards the grinding wheel and into contact with the movable guide member, sandwiching the knife between the grinding surface and the movable member such that the movable member is displaced in accordance with the blade contour; and drawing the blade across the grinding surface to sharpen the blade edge.

11. The method of claim 10 further comprising rotating the grinding wheel in a direction opposite to a direction of insertion of the knife blade into the sharpener.

* * * * *